US008657348B2

(12) United States Patent
Coleman et al.

(10) Patent No.: US 8,657,348 B2
(45) Date of Patent: Feb. 25, 2014

(54) LATCH ASSEMBLY

(75) Inventors: Peter Coleman, Droitwich (GB); Gurbinder Singh Kalsi, Oldbury (GB)

(73) Assignee: Inteva Products, LLC, Troy, MI (US)

( * ) Notice: Subject to any disclaimer, the term of this patent is extended or adjusted under 35 U.S.C. 154(b) by 0 days.

(21) Appl. No.: 13/152,608

(22) Filed: Jun. 3, 2011

(65) Prior Publication Data

US 2012/0091738 A1 Apr. 19, 2012

(30) Foreign Application Priority Data

Jun. 4, 2010 (GB) ..... 1009352.4

(51) Int. Cl.
*E05C 3/06* (2006.01)
*E05C 3/16* (2006.01)

(52) U.S. Cl.
USPC ..... 292/198; 292/200; 292/216; 292/DIG. 23

(58) Field of Classification Search
USPC ..... 292/216, DIG. 23, 200
See application file for complete search history.

(56) References Cited

U.S. PATENT DOCUMENTS

| | | | | |
|---|---|---|---|---|
| 3,905,627 | A | 9/1975 | Fujita | |
| 4,988,135 | A * | 1/1991 | Ottino | 292/201 |
| 6,428,058 | B1 * | 8/2002 | Graute | 292/216 |
| 6,511,106 | B2 * | 1/2003 | Perkins et al. | 292/216 |
| 6,817,636 | B1 * | 11/2004 | Evans et al. | 292/201 |
| 7,264,283 | B2 * | 9/2007 | Stoof et al. | 292/216 |
| 7,500,700 | B2 * | 3/2009 | Kunst | 292/201 |
| 7,827,836 | B2 * | 11/2010 | Cetnar | 70/257 |
| 2008/0217928 | A1 * | 9/2008 | Spurr | 292/198 |
| 2009/0199605 | A1 * | 8/2009 | Spurr et al. | 70/266 |
| 2010/0194120 | A1 | 8/2010 | Kaiser et al. | |
| 2011/0260475 | A1 * | 10/2011 | Spurr et al. | 292/195 |

FOREIGN PATENT DOCUMENTS

| | | | |
|---|---|---|---|
| EP | 1 724 421 | A2 | 11/2006 |
| EP | 1724421 | A2 * | 11/2006 |
| EP | 1 748 130 | A2 | 1/2007 |
| EP | 1820926 | A2 * | 8/2007 |

(Continued)

OTHER PUBLICATIONS

Patents Act 1977: Search Report under Section 17—Application No. GB1009352.4.

(Continued)

*Primary Examiner* — Carlos Lugo
*Assistant Examiner* — Faria Ahmad
(74) *Attorney, Agent, or Firm* — Cantor Colburn LLP

(57) ABSTRACT

A latch assembly is provided herein, the latch assembly having: a chassis; a latch bolt, movably mounted on the chassis and having a closed position for retaining a striker, an open position for releasing the striker; a first safety position between the closed position and the open position for retaining the striker; a first pawl having a first pawl engaged position at which the first pawl is engageable with the latch bolt to hold the latch bolt in the closed position and a first pawl disengaged position at which the first pawl is disengaged from the latch bolt thereby allowing the latch bolt to at least move towards the first safety position; and a second pawl having a second pawl engaged position at which the second pawl is engageable with the latch bolt to hold the latch bolt in the first safety position and a second pawl disengaged position at which the second pawl is disengaged from the latch bolt thereby allowing the latch bolt to move towards the open position.

16 Claims, 8 Drawing Sheets

(56) References Cited

FOREIGN PATENT DOCUMENTS

| | | | | |
|---|---|---|---|---|
| EP | 2 169 157 | A2 | | 3/2010 |
| GB | 2423333 | A | * | 8/2006 |
| GB | 2433768 | A | * | 7/2007 |
| WO | 2004/101931 | A1 | | 11/2004 |
| WO | WO 2006087578 | A1 | * | 8/2006 |
| WO | WO 2008102097 | A1 | * | 8/2008 |
| WO | 2008/145230 | A1 | | 12/2008 |
| WO | 2009/149685 | A2 | | 12/2009 |

OTHER PUBLICATIONS

GB Application No. 1009352.4 Office Action dated Oct. 23, 2013.

* cited by examiner

LATCH ASSEMBLY

CROSS REFERENCE TO RELATED APPLICATIONS

This application claims priority under 35 U.S.C. §119 to the following patent application UK Patent Application No. 1009352.4 filed Jun. 4, 2010, the contents of which are incorporated herein by reference thereto.

BACKGROUND

The present invention relates to latch assemblies, in particular latch assemblies for use with car doors, such as driver's doors, front passenger doors, rear passenger doors. Latch assemblies can be used on any other type of vehicle such as lorries, vans, pickups etc.

Latch assemblies are known to releasably secure doors in a closed position. Operation of an inside door handle or an outside door handle releases the latch allowing the door to open. Subsequent closure of the door will automatically relatch the latch.

Conventional latches (typically mounted on a vehicle door) have a latch bolt, typically in the form of a rotating claw which can be held in a closed position thereby retaining a striker (typically mounted on a door aperture) so as to hold an associated door closed. The latch can also be held in a first safety position by engagement between the pawl and claw. This first safety position is not a fully closed position, rather the door is slightly open, or ajar, but nevertheless held in this ajar position by the latch, i.e. in spite of being in the ajar position, the door will not open.

Traditionally, the claw will have a closed abutment and a first safety abutment. When the pawl engages the closed abutment the door is in the fully closed position and when the pawl engages the first safety abutment the door is in the first safety position. Alternatively the pawl can be provided with two abutments, namely a closed abutment and a first safety abutment. Engagement between the closed abutment of the pawl and the claw will hold the door in the closed position and engagement between the first safety abutment of the pawl and the claw will hold the door in the first safety position.

The pawl is rotatable about a pawl axis into and out of engagement with the claw. Typically the axis about which the pawl rotates is a fixed axis.

The first safety position is provided as a safety measure. With the door fully closed and the vehicle is being driven, in the event that the pawl abutment is disengaged from the claw abutment, the door will open but only as far as the first safety position. The driver and/or other vehicle occupant will be alerted to the fact that the door is ajar and will take appropriate action. In particular, should the pawl become disengaged from the claw in the closed position, the door will not fly open and endanger vehicle occupants.

Car doors have "weather" seals typically around their periphery. These seals are made from elastomeric material and when the door is in the closed and in the first safety position the weather seals are compressed therefore ensuring rain and dirt does not enter the vehicle. As will be appreciated, with the weather seals in a compressed condition, they tend to force the door open and this force is resisted by the pawl and claw.

Under normal conditions when the latch is initially opened the weather seals will push the door open sufficiently far to disengage the striker from the claw. Thus, for a door hinged at its front edge with a latch on its rear edge and a striker mounted on the door aperture, the weather seals might spring the door open at its rear edge by 50 to 100 mm. Clearly, for a driver to enter the vehicle he or she must then fully open the door.

However, under certain circumstances the door seals will not push the door to a position where the striker is fully disengaged from the claw. Thus, consider the circumstances of a vehicle being parked in the evening following a rainstorm. The vehicle and parts of the weather seals will be wet from the rain. Over night the temperature drops, and in this example drops to below freezing whereupon the water around the weather seals freezes and also the weather seals themselves cool to below freezing. The following morning when the driver comes to open the door the weather seals will be adhered to the door by ice and frost. The driver will attempt to open the driver's door but the ice and frost will prevent this. Under certain circumstances the door may move slightly, for example the latch may move 1 mm in an opening direction relative to the striker. The door may then be left in this position and the driver may then attempt and succeed at entering the vehicle via another door. However, as far as the driver's door is concerned, because of the slight movement of the latch relative to the striker, the pawl will not be able to reengage with the closed abutment on the claw (in this example it is the claw that has a closed abutment and a first safety abutment). As the vehicle is driven, it will warm up and the ice and frost will melt. As this occurs, the weather seals will then push the door open, but only as far as the first safety position since the pawl will engage the first safety abutment on the claw and prevent further opening of the door. Thus, under these circumstances it is safe to operate a conventional latch.

Alternative latches also have rotatable pawls but the axis about which the pawl rotates is able to move. Such latches must be able to operate safely even when the door seals are frozen.

Thus, an object of the present invention is to provide an improved door latch.

SUMMARY OF THE INVENTION

According to one non-limiting exemplary embodiment of the present invention a door latch assembly is provided. The latch assembly having: a chassis; a latch bolt, movably mounted on the chassis and having a closed position for retaining a striker, an open position for releasing the striker; a first safety position between the closed position and the open position for retaining the striker; a first pawl having a first pawl engaged position at which the first pawl is engageable with the latch bolt to hold the latch bolt in the closed position and a first pawl disengaged position at which the first pawl is disengaged from the latch bolt thereby allowing the latch bolt to at least move towards the first safety position; and a second pawl having a second pawl engaged position at which the second pawl is engageable with the latch bolt to hold the latch bolt in the first safety position and a second pawl disengaged position at which the second pawl is disengaged from the latch bolt thereby allowing the latch bolt to move towards the open position.

BRIEF DESCRIPTION OF THE DRAWINGS

The invention will now be described by way of example only with reference to the accompanying drawings in which.

DETAILED DESCRIPTION OF EXEMPLARY EMBODIMENTS

Figure 1:
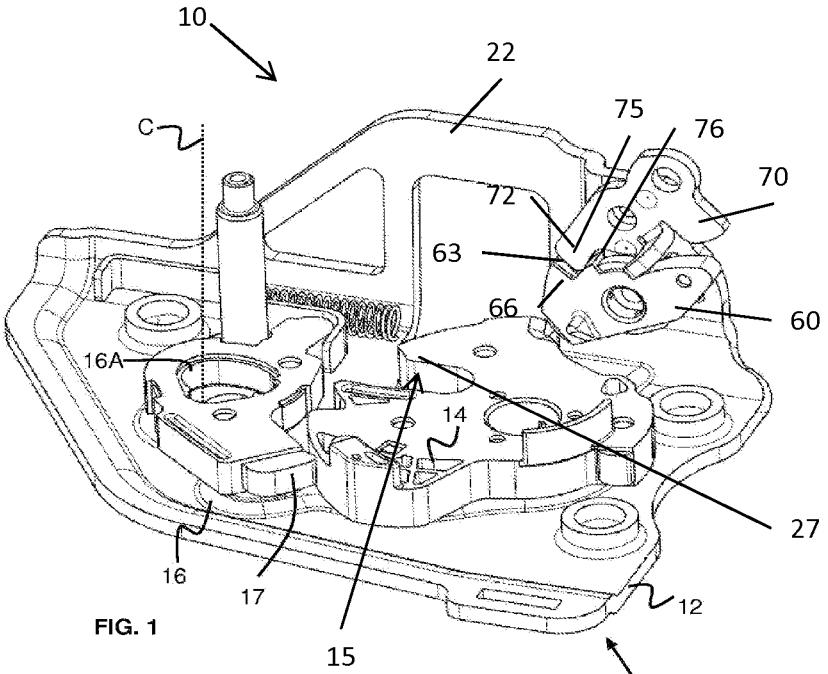
FIGS. 1 to 4 show various views of a latch assembly according to the present invention being progressively open from a first safety position to an open position.
Figure 2:
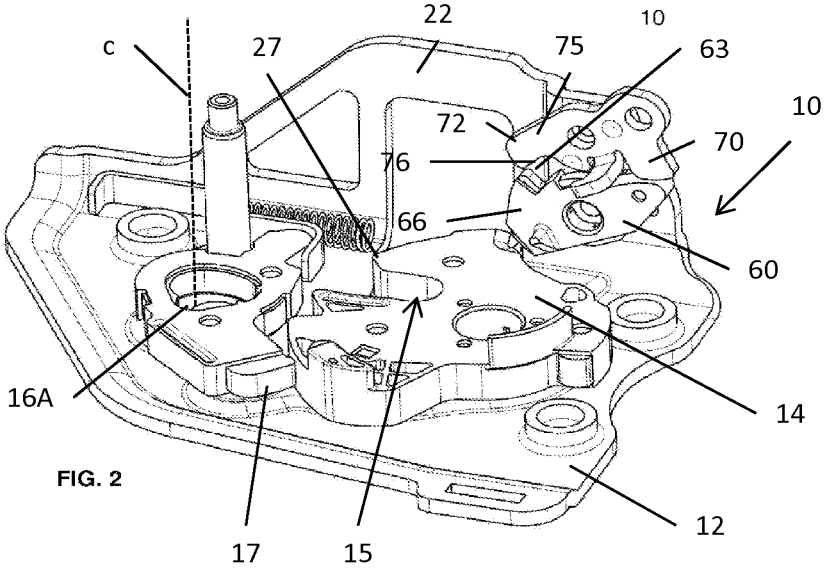
Figure 3:
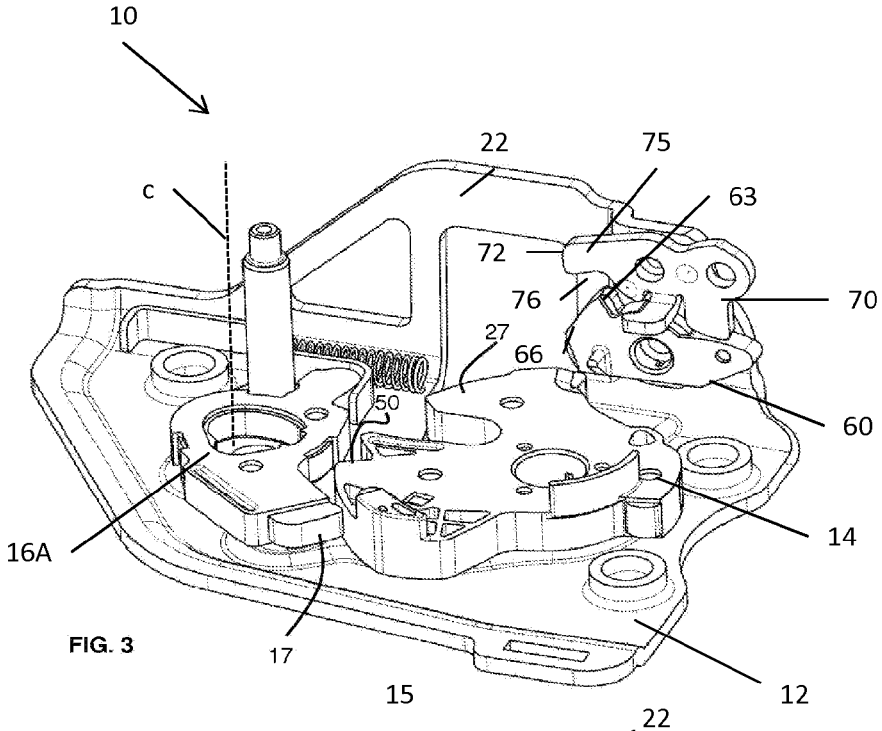
Figure 4:
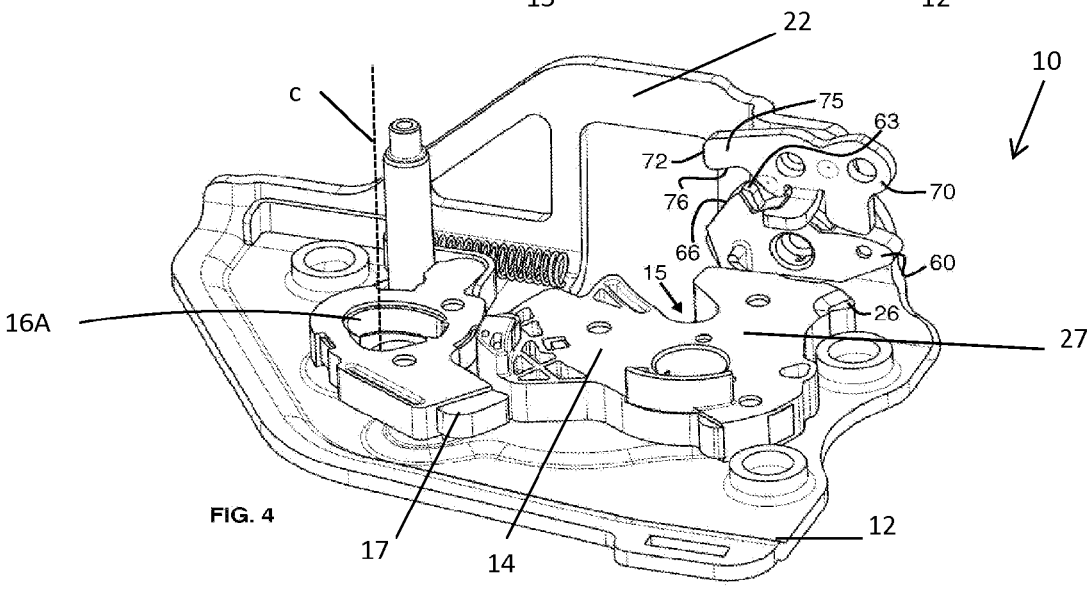

With reference to FIGS. 1 to 13 there is shown a latch, assembly 10 having a latch chassis 12, a latch bolt in the form of a rotating claw 14, a first pawl 16, an eccentric arrangement in the form of a crank shaft 18.

The latch chassis 12 includes a retention plate 22 and a backplate (not shown). The rotating claw 14 is pivotably mounted on a claw pivot pin (not shown). One end of the claw pivot pin is mounted in the retention plate and the other end of claw pivot pin is mounted in the backplate. A crank shaft bush 30 is mounted on the backplate and rotatably receives a portion of the crank shaft 18. An end of crank shaft 18 includes a lug (not visible) upon which the pawl 16 is rotatably mounted via hole 16A. The lug in conjunction with hole 16A define a pawl pivot axis C parallel to but offset from the axis B about which crank shaft 18 rotates. The shape of hole 16 is generally oval with a bulge on one side and the shape of lug is generally circular with a bulge on one side. These shapes help to reduce friction whilst maintaining sufficient strength in the lug. For a full explanation see International patent application PCT/GB2008/000328, the contents of which are hereby incorporated by reference.

A crank shaft lever 34 is non-rotatably fixed to one end of crank shaft 18. The crank shaft lever defines a release pawl abutment 38.

Rotatably mounted via a pin (not shown) secured to the backplate is release pawl 42. The release pawl is rotatably mounted about axis D via hole 42A.

A release lever 44 is pivotable about axis E. Release lever 44 includes a pin 46.

Operation of the latch is similar in principle to operation of the latch as shown in International patent application PCT/GB2006/000586, the contents of which are hereby incorporated by reference. However, in summary:

With the latch in a closed position the first pawl tooth 17 engages the closed abutment 50 of the rotating claw 14. The release pawl tooth 43 is engaged with the release pawl abutment 38 of the crankshaft lever 34 thereby ensuring the crank shaft 18 is in a first position and the first pawl axis C is in the first pawl axis position C1. The release lever 44 is in a rest position.

In order to release the latch, the release lever is rotated about release lever axis E to a released position whereupon pin 46 on the release lever engages and moves the release pawl 42 rotatably about axis D so that the release pawl tooth 43 is disengaged from the release pawl abutment 38 of the crank shaft lever 34. The crank shaft is now no longer held in its first position and the geometry of the pawl tooth 17, closed abutment 50 of the rotating claw, and relative positions of the crank shaft axis B and pawl axis C1 are such that the crank shaft lever 34 swings clockwise (when viewing FIG. 12) about crank shaft axis B thereby disengaging the first pawl 16 from the rotating claw 14 and allowing the latch to open as the striker exits the mouth 15 of the claw. This clockwise rotation of the crankshaft causes the first pawl axis C to move from its first position C1 to its second position C2 (see FIG. 13).

The release lever 44 is connected to an inside door handle and an outside door handle and optionally to a release motor. When the door is manually operated, under normal circumstances, the inside or outside door handle will be pulled, thereby moving the release lever from the rest position to its release position. This movement will move the release pawl 42 from its retaining position to its non retaining position. The first pawl axis is then allowed to move from the first position C1 to the second position C2 allowing the first pawl to release the claw and for the claw to release the striker. The inside or outside door handle will then be released by the operator which will move the release lever to the rest position.

Subsequent closing of the door will cause the striker to move into the mouth 15 and rotate the claw to the fully closed position whereupon the pawl tooth 17 will engage the closed abutment 50.

Traditional latches have an open position and a closed position. Some latches also have an ajar position, i.e. a first safety position, wherein the associated door is not fully closed (i.e. it is slightly ajar) but nevertheless the striker is retained in the mouth of the latch bolt thereby preventing the door from opening.

A first safety position is provided on the present latch as follows:—

Figure 5:
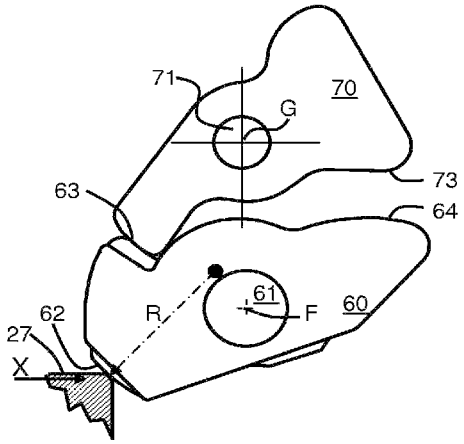
FIGS. 5 to 7 show part views of FIGS. 1, 2 and 3 respectively.

A second pawl 60 is rotatably mounted via pin 61 about axis F on the latch chassis 12. Second pawl 60 includes a first abutment 62, a second abutment 63 and a third abutment 64. An auxiliary pawl 70 is rotatably mounted via pin 71 about axis G to the latch chassis 12. The auxiliary pawl has a first abutment 72 and a second abutment 73. FIGS. 1 and 5 show the second pawl 60 in a second pawl engaged position wherein the first abutment 62 is engaged with a claw abutment 26. The claw 14 is biased in the direction of arrow X due to the relative geometry of the claw abutment 26 and the first abutment 62. A force N is transmitted to the second pawl 60 in a direction perpendicular to the contact point at first abutment 62 and a frictional force P is transmitted to the second pawl in a direction parallel to the contact surface at the first abutment 62. As can be seen from FIG. 6, a projection of the force N does not pass through axis F rather it passes through one side of axis F (by distance A1). As such, force N creates a clockwise moment on the secondary pawl 60 tending to rotate it clockwise about axis F.

This clockwise rotation is resisted by the auxiliary pawl 70, in particular by contact between the second abutment 63 of the second pawl and the first abutment 72 of the auxiliary pawl.

Figure 6:
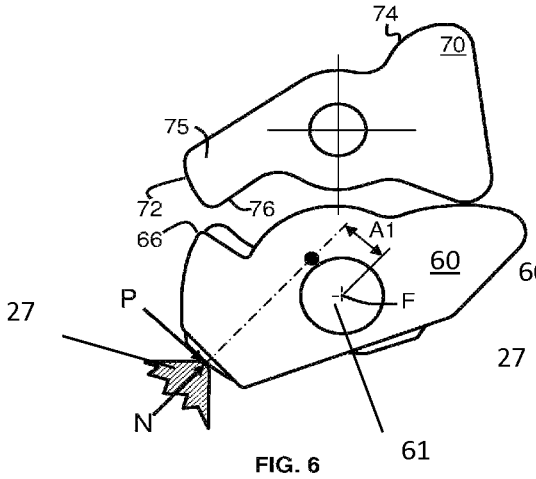
Figure 7:
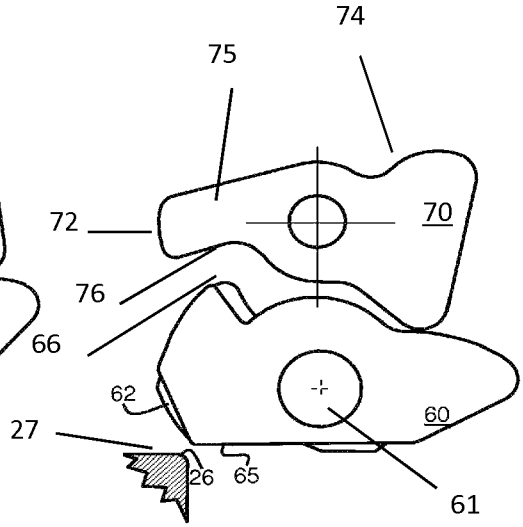

Rotation of the auxiliary pawl 70 in a clockwise direction about axis G will disengage abutment 72 from abutment 63 (see especially FIGS. 5 and 6).

Continued clockwise rotation of the auxiliary pawl 70 will cause the second abutment 73 of the auxiliary pawl to engage the third abutment 64 of the second pawl 60 and cause the second pawl 60 to also rotate clockwise thereby disengaging the first abutment 62 from the claw abutment 26.

The auxiliary pawl 70 can be rotated in this clockwise direction by the release lever 44, in particular by pin 45 of release lever 44. As the release lever 44 is moved from its rest position to its released position, pin 45 engages third abutment 74 of the auxiliary pawl thereby rotating the auxiliary pawl clockwise (when viewing FIG. 6).

In summary, to open the door starting with the rotating claw in its closed position an inside door handle, outside door handle or motor is actuated which rotates the release lever 44 bout axis E in the direction of arrow R. This causes pin 46 to move the release pawl out of engagement with the crank shaft lever 34 as described above and causes pin 45 to engage abutment 74 thereby rotating the auxiliary pawl clockwise (when viewing FIG. 6) and also rotating the secondary pawl clockwise (when viewing FIG. 6). Typically the arrangement is such that the second pawl 60 is caused to rotate to the position shown in FIG. 7 just before release pawl 43 disengages from release pawl abutment 38. This ensures that the first abutment 62 does not interrupt the opening of the claw as the first pawl tooth 17 is disengaged from the closed abutment 50.

Thus, pawl tooth 17 is disengaged from the closed abutment 50 of the claw and first abutment 62 of the second pawl has been moved out of the path of movement of the claw abutment 26. As such, the claw is now free to rotate to its open position.

Once the door is open, the inside or outside door handle is released by the operator and the release lever 44 returns to its rest position, thereby moving pin 46 to a position whereby it no longer restricts movement of the release pawl 42 to reengage the crank shaft lever 34. The crank shaft can be reset to its closed position as described in International patent application PCT/GB2006/000586. In summary, a pin on the claw can cause the crank shaft to reset as the claw opens, alternatively a pin on the claw can cause the crank shaft to reset during closing of the latch prior to the closed abutment 50 passing under the first pawl tooth 17.

Releasing of the handle also moves pin 44 away from the third abutment 74. However, because the fourth abutment 65 of the second pawl 60 is resting on an edge 27 of the claw 14, the second pawl 60 is held in the position shown in FIG. 4. As can be seen from FIG. 4 the second abutment 63 of the second pawl 60 is underneath arm 75 upon which is positioned, at an end, the first abutment 72. As such, as the handle is released the release lever is released, the auxiliary pawl 70 simply moves from the position shown in FIG. 4 to a position where abutment 76 of the auxiliary pawl rests against edge 66 of the secondary pawl (since the auxiliary pawl 70 is biased in an anticlockwise direction by a relatively light spring).

Figure 8:
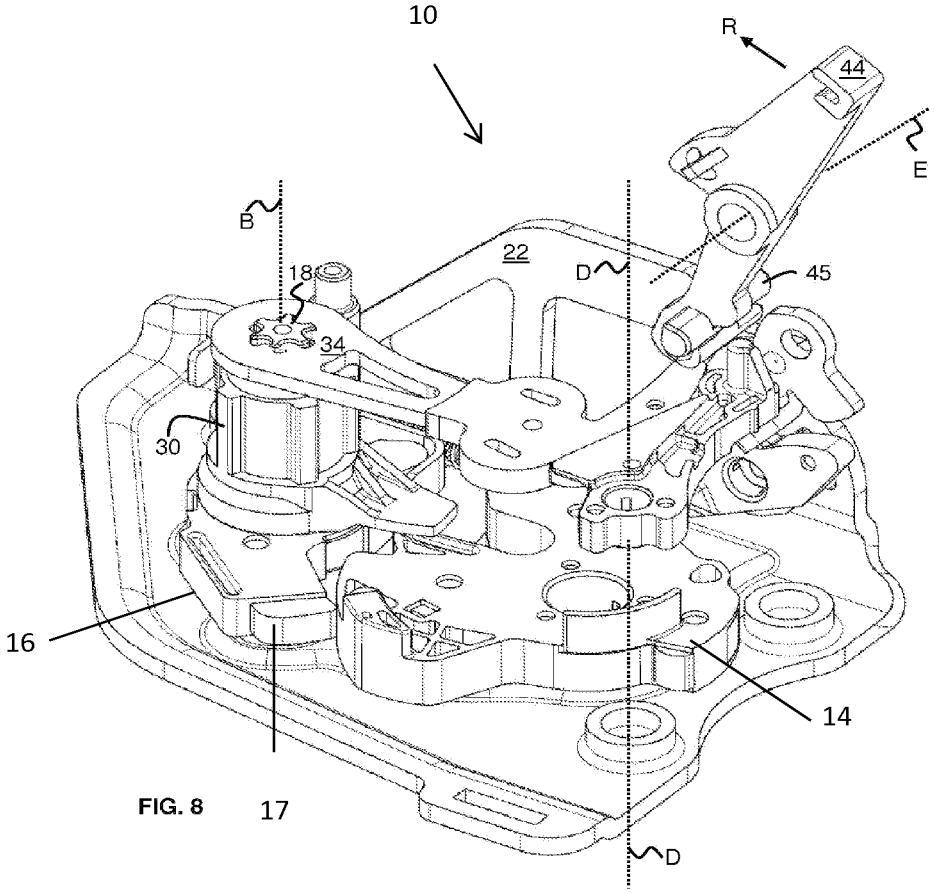
FIGS. 8 to 12 show how the components of the latch of FIG. 1 are required to move to allow the latch to open from the first safety position.
Figure 9:
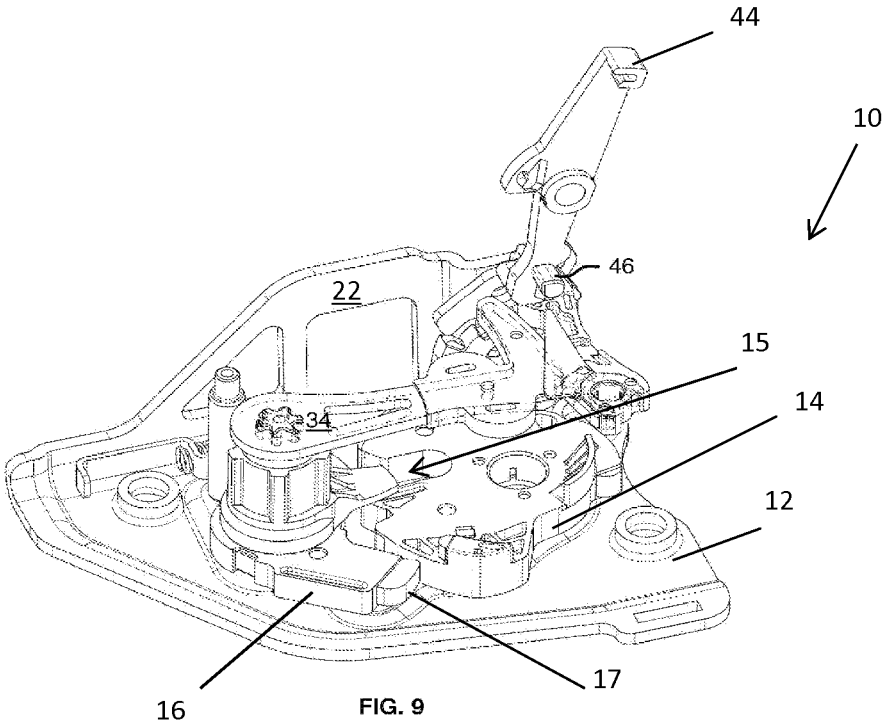
Figure 10:
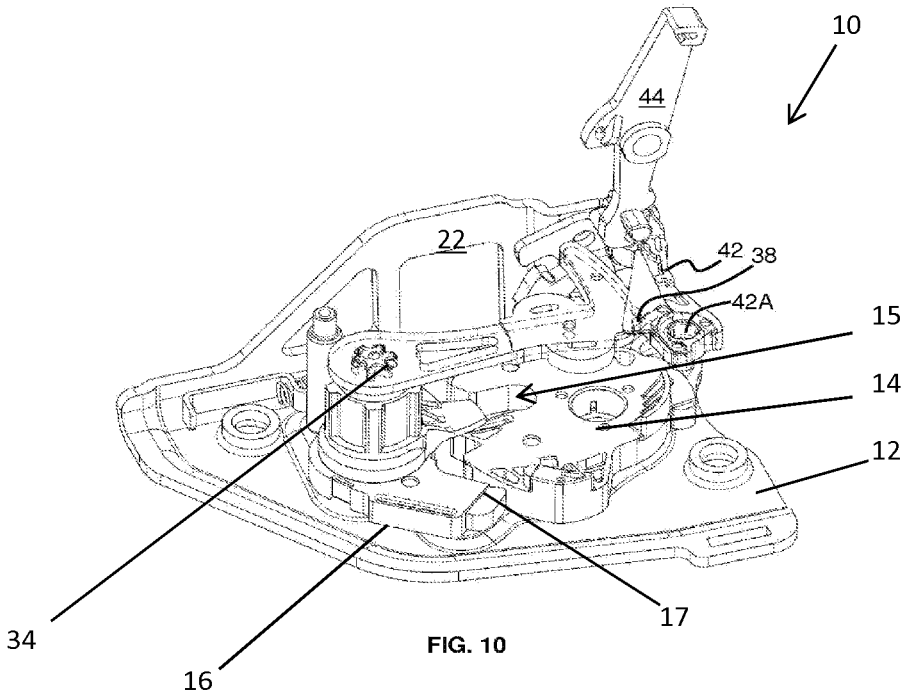
Figure 11:
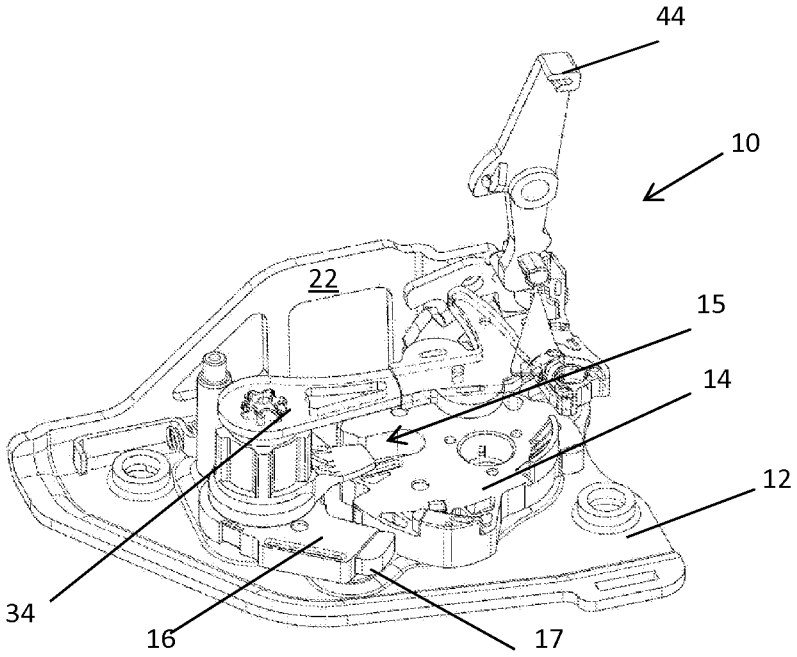
Figure 12:
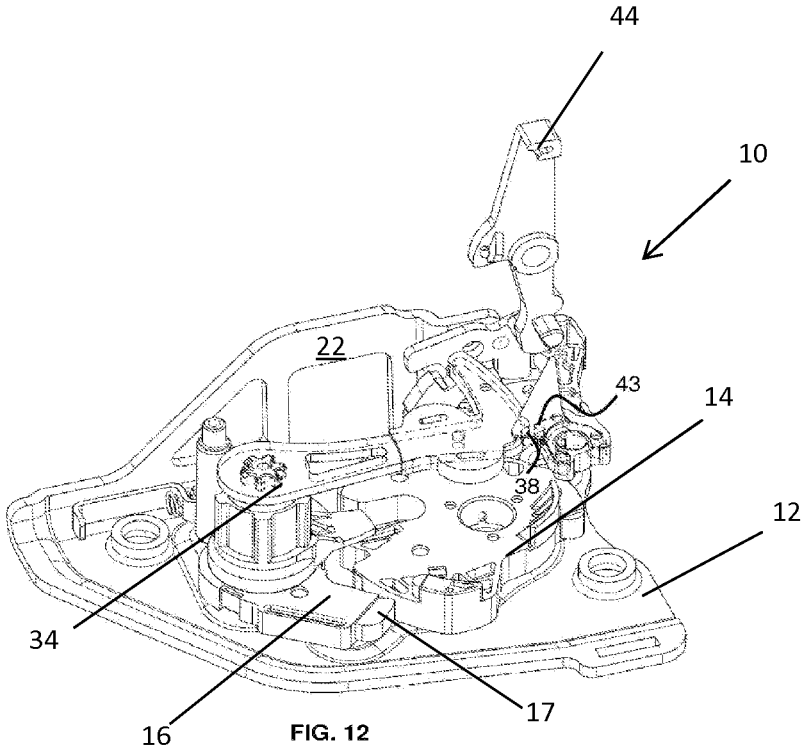
Figure 13:
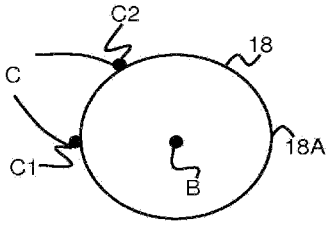
FIG. 13 shows a schematic end view of the crankshaft of FIG. 1.

With the door open and the handle released, consider the situation where the door is pushed close sufficiently far to engage the first safety position of the latch, but not sufficiently far so as to fully close the door. Under these circumstances as the claw rotates in a closing direction edge 27 slides under the fourth abutment 65 until such time as the claw abutment 26 passes beyond the first abutment 62 of the second pawl 60. Once this occurs the second pawl 60 will rotate to a position shown in FIG. 5 (under the action of a relatively light spring causing it to rotate in an anticlockwise direction). Once in this position the edge 66 of the secondary pawl will have moved beyond the first abutment 72 of the auxiliary pawl allowing the first abutment 72 of the auxiliary pawl to reengage with the second abutment 63 of the second pawl thereby returning the auxiliary pawl to the FIG. 5 position. Once the second pawl and auxiliary pawl have been returned to the FIG. 5 position, then the claw will be held in a first safety position, thereby preventing opening of the door. FIGS. 1, 5 and 8 show the latch assembly in this first safety position. From this first safety position, the door can either by pushed further closed or more normally opened and then slammed harder to ensure latch moves to the closed position.

In the event that the door seals may be frozen then the operation of the door is as follows:

An operator will lift an outside door handle thereby moving the release lever 44 from the rest position to the released position. This in turn moves the second pawl and auxiliary pawl to the position shown in FIG. 7 and moves the release pawl 42 from the retaining position to the non-retaining position. For the purposes of explanation, it is assumed the first pawl axis moves from the first pawl axis position C1 to the second pawl axis position C2 and the closed abutment 50 of the claw moves under the first pawl tooth 17. However, because of the frozen door seals the claw abutment 26 does not move under the first abutment 62. The driver is unable to open the door and therefore releases the door handle and enters the vehicle via an alternative route. Upon release of the door handle the second pawl and auxiliary pawl returned to the position shown in FIG. 5.

In particular, as the door seals unfreeze, the door seals will push the door out, but only until such time as claw abutment 26 engages the first abutment 62 of the second pawl. This engagement will prevent further opening of the door.

As described above a projection of the force N passes to one side of axis F causing a turning moment on the pawl 60 in an opening direction (in this case a clockwise direction). In further embodiments a projection of the force N could pass through pivot axis F, or alternatively could pass to an opposite side of the axis F i.e. the force could create a turning moment on the pawl in a closing direction (or a retaining direction) of the pawl, i.e. in an anticlockwise direction when considering FIG. 6.

Under certain circumstances the auxiliary pawl 70 can be dispensed with and the pin 45 can engage and move the second pawl directly. However, under these circumstances typically the forces required to move the secondary pawl will be higher.

As described above, the first pawl engages the claw at closed abutment 50 and the second pawl engages the claw at pawl abutment 26, in other words the first pawl engages the claw by a different abutment to the abutment at which the second pawl engages the claw. In further embodiments the first and second pawls could engage the claw at the same abutment when the claw is in the closed and first safety position respectively.

Vehicles have front and rear doors with typically rear doors requiring child safety features whereas the front doors do not require any such child safety features. Some vehicles are right hand drive and some vehicles are left hand drive and typically the driver's door will include a key barrel operable by a key, whereas the front passenger door will not.

Where a child safety feature is fitted, this can be a manually operated child safety feature (MCS) or alternatively it can be an electrically operated child safety feature (ECS).

Latches will typically require locking, and certain latches require certain security statuses. Central door locking (CDL) refers to a system of remotely locking the latch, typically by using an electric motor. The latch will be locked, but not superlocked, i.e. with the latch locked, pulling the outside door handle will not open the latch but operating the inside door handle will open the latch. Alternatively, superlocking (SL) latches can be provided wherein in the superlocked condition operating either the outside door handle or the inside door handle will not open the latch.

Some latches can include a power closure feature (PC). Thus, once the door has been closed to the first safety position, the power actuator, typically an electric motor, will then drive the claw from the first safety position to the fully closed position.

Some vehicles include adaptive cruise control systems where the speed of the vehicle varies in cruise control mode dependent upon the proximity of other vehicles. When a traffic jam occurs the adaptive cruise control system can slow the vehicle to a standstill. When the traffic jam clears the adaptive cruise control system will accelerate the vehicle from a standstill. It is important that the driver is still in the vehicle when it accelerates away from its stationary position. Thus, whilst latches traditionally include an ajar switch but indicates that the door has been opened, where adaptive cruise control systems are used an additional ajar switch may be incorporated to ensure that the driver has not exited the vehicle whilst stationary and under adaptive cruise control. This additional ajar switch will be located in the latch.

Table 1 below shows typical variants (in this case 32 variants) of door latches according to the present invention.

TABLE 1

| | Position | | | | Locking | | Drive | | Key | | Child Safety | | ACC+ | Power closure |
|---|---|---|---|---|---|---|---|---|---|---|---|---|---|---|
| Variant | Front | Rear | RH | LH | CDL | SL | RHD | LHD | Key | No Key | Manual | Electric | Yes | Yes |
| 1 | X | | X | | | X | X | | X | | | | | |
| 2 | X | | | X | | X | | X | X | | | | | |
| 3 | X | | X | | | X | X | | X | | | | X | |
| 4 | X | | | X | | X | | X | X | | | | X | |
| 5 | X | | X | | | X | | X | | X | | | | |
| 6 | X | | | X | | X | X | | | X | | | | |
| 7 | | X | X | | | X | | | | | X | | | |
| 8 | | X | | X | | X | | | | | X | | | |
| 9 | | X | X | | | X | | | | | | X | | |
| 10 | | X | | X | | X | | | | | | X | | |
| 11 | X | | X | | | X | X | | X | | | | X | X |
| 12 | X | | | X | | X | | X | X | | | | X | X |
| 13 | X | | X | | | X | | X | | X | | | X | X |
| 14 | X | | | X | | X | X | | | X | | | X | X |
| 15 | | X | X | | | X | | | | | | X | | X |
| 16 | | X | | X | | X | | | | | | X | | X |
| 17 | X | | X | | X | | | X | | X | | | | |
| 18 | X | | | X | X | | | X | X | | | | | |
| 19 | X | | X | | X | | X | | X | | | | X | |
| 20 | X | | | X | X | | | X | X | | | | X | |
| 21 | X | | X | | X | | | X | | X | | | | |
| 22 | X | | | X | X | | X | | | X | | | | |
| 23 | | X | X | | X | | | | | | X | | | |
| 24 | | X | | X | X | | | | | | X | | | |
| 25 | | X | X | | X | | | | | | | X | | |
| 26 | | X | | X | X | | | | | | | X | | |
| 27 | X | | X | | X | | | X | | X | | | X | X |
| 28 | X | | | X | X | | | X | X | | | | X | X |
| 29 | X | | X | | X | | | X | | X | | | | X |
| 30 | X | | | X | X | | X | | | X | | | | X |
| 31 | | X | X | | X | | | | | | | X | | X |
| 32 | | X | | X | X | | | | | | | X | | X |

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch assembly, comprising:

a chassis;

a latch bolt, movably mounted on the chassis and having a closed position for retaining a striker, an open position for releasing the striker; and a first safety position between the closed position and the open position for retaining the striker;

a first pawl having a first pawl engaged position at which the first pawl is engageable with the latch bolt to hold the latch bolt in the closed position and a first pawl disengaged position at which the first pawl is disengaged from the latch bolt thereby allowing the latch bolt to at least move towards the first safety position;

a second pawl having a second pawl engaged position at which the second pawl is engageable with the latch bolt to hold the latch bolt in the first safety position and a second pawl disengaged position at which the second pawl is disengaged from the latch bolt thereby allowing the latch bolt to move towards the open position;

an eccentric arrangement defining an eccentric axis and a first pawl axis spaced from the eccentric axis, with the eccentric arrangement being rotatable about the eccentric axis and with the first pawl being rotatable about the first pawl axis;

wherein as the first pawl moves from the first pawl engaged position to the first pawl disengaged position the eccentric arrangement rotates about the eccentric axis to move the first pawl axis from a first pawl axis position to a second pawl axis position;

a retaining mechanism having a retaining position at which the first pawl axis is held at the first pawl axis position and having a non-retaining position at which the pawl axis is allowed to move to the second pawl axis position;

a release lever operable to move the retaining mechanism from the retaining position to the non-retaining position when the release lever is moved from a rest position to a released position; and an auxiliary pawl engageable with the second pawl to hold the second pawl in the second pawl engaged position, the auxiliary pawl being adapted to be moved to a position that causes the second pawl to move towards the second pawl disengaged position, wherein movement of the auxiliary pawl to the position causes an abutment on the auxiliary pawl to move the second pawl to the second pawl disengaged position.

2. The latch assembly as in claim 1, wherein the first pawl engages a first abutment of the latch bolt when the latch bolt is in the closed position and the second pawl engages a second abutment of the latch bolt when the latch bolt is in the first safety position.

3. The latch assembly as in claim 1, further comprising an inside door handle operably connected to the release lever.

4. The latch assembly as in claim 3 further comprising an outside door handle operably connected to the release lever.

5. The latch assembly as in claim 4 further comprising a power operated actuator operably connected to the release lever.

6. The latch assembly as in claim 1 further comprising a power operated actuator operably connected to the release lever.

7. The latch assembly as in claim 6 wherein when the first pawl moves from the first pawl engaged position to the first pawl disengaged position the eccentric arrangement rotates in one of a clockwise and anticlockwise direction and with the first pawl in the first pawl engaged position a force applied to the first pawl by the latch bolt creates a turning moment on the eccentric arrangement about the eccentric axis in said one of a clockwise and anticlockwise direction and the eccentric arrangement is prevented from rotating in said one of a clockwise and anticlockwise direction by the retaining mechanism.

8. The latch assembly as in claim 7, wherein the retaining mechanism is defined by a moveable abutment.

9. The latch assembly as in claim 8, wherein the latch is in the closed position a release abutment of the eccentric arrangement engages the moveable abutment to prevent the eccentric arrangement from moving.

10. The latch assembly as in claim 9, wherein the first pawl engages a first abutment of the latch bolt when the latch bolt is in the closed position and the second pawl engages a second abutment of the latch bolt when the latch bolt is in the first safety position.

11. A latch assembly, comprising:

a chassis;

a latch bolt, movably mounted on the chassis and having a closed position for retaining a striker, an open position for releasing the striker; and a first safety position between the closed position and the open position for retaining the striker;

a first pawl having a first pawl engaged position at which the first pawl is engageable with the latch bolt to hold the latch bolt in the closed position and a first pawl disengaged position at which the first pawl is disengaged from the latch bolt thereby allowing the latch bolt to at least move towards the first safety position;

a second pawl having a second pawl engaged position at which the second pawl is engageable with the latch bolt to hold the latch bolt in the first safety position and a second pawl disengaged position at which the second pawl is disengaged from the latch bolt thereby allowing the latch bolt to move towards the open position;

an eccentric arrangement defining an eccentric axis and a first pawl axis spaced from the eccentric axis, with the eccentric arrangement being rotatable about the eccentric axis and with the first pawl being rotatable about the first pawl axis;

wherein as the first pawl moves from the first pawl engaged position to the first pawl disengaged position the eccentric arrangement rotates about the eccentric axis to move the first pawl axis from a first pawl axis position to a second pawl axis position; and a retaining mechanism having a retaining position at which the first pawl axis is held at the first pawl axis position and having a non-retaining position at which the pawl axis is allowed to move to the second pawl axis position;

a release lever operable to move the retaining mechanism from the retaining position to the non-retaining position when the release lever is moved from a rest position to a released position, wherein when the first pawl moves from the first pawl engaged position to the first pawl disengaged position the eccentric arrangement rotates in one of a clockwise and anticlockwise direction and with the first pawl in the first pawl engaged position a force applied to the first pawl by the latch bolt creates a turning moment on the eccentric arrangement about the eccentric axis in said one of a clockwise and anticlockwise direction and the eccentric arrangement is prevented from rotating in said one of a clockwise and anticlockwise direction by the retaining mechanism; and an auxiliary pawl having an auxiliary pawl retaining position at which the auxiliary pawl is engageable with the second pawl to hold the second pawl in the second pawl engaged position and an auxiliary pawl release position at which the auxiliary pawl allows the second pawl to move towards the second pawl disengaged position, wherein movement of the auxiliary pawl from the auxiliary pawl retaining position to the auxiliary pawl release position causes an abutment on the auxiliary pawl to move the second pawl to the second pawl disengaged position.

12. A latch assembly, comprising:

a chassis;

a latch bolt, movably mounted on the chassis and having a closed position for retaining a striker, an open position for releasing the striker; and a first safety position between the closed position and the open position for retaining the striker;

a first pawl having a first pawl engaged position at which the first pawl is engageable with the latch bolt to hold the latch bolt in the closed position and a first pawl disengaged position at which the first pawl is disengaged from the latch bolt thereby allowing the latch bolt to at least move towards the first safety position;

a second pawl having a second pawl engaged position at which the second pawl is engageable with the latch bolt to hold the latch bolt in the first safety position and a second pawl disengaged position at which the second pawl is disengaged from the latch bolt thereby allowing the latch bolt to move towards the open position;

an eccentric arrangement defining an eccentric axis and a first pawl axis spaced from the eccentric axis, with the eccentric arrangement being rotatable about the eccentric axis and with the first pawl being rotatable about the first pawl axis;

wherein as the first pawl moves from the first pawl engaged position to the first pawl disengaged position the eccentric arrangement rotates about the eccentric axis to move the first pawl axis from a first pawl axis position to a second pawl axis position;

a retaining mechanism having a retaining position at which the first pawl axis is held at the first pawl axis position and having a non-retaining position at which the pawl axis is allowed to move to the second pawl axis position;

a release lever operable to move the retaining mechanism from the retaining position to the non-retaining position when the release lever is moved from a rest position to a released position; and an auxiliary pawl having an auxiliary pawl retaining position at which the auxiliary pawl is engageable with the second pawl to hold the second pawl in the second pawl engaged position and an auxiliary pawl release position at which the auxiliary pawl allows the second pawl to move towards the second pawl disengaged position, wherein movement of the auxiliary pawl from the auxiliary pawl retaining position to the auxiliary pawl release position causes an abutment on the auxiliary pawl to move the second pawl to the second pawl disengaged position.

13. The latch assembly as in claim 12, wherein the second pawl is rotatable about a second pawl axis and with the latch bolt in the first safety position and the second pawl in the second pawl engaged position a force applied to the second pawl by the latch bolt passes to one side of the second pawl axis so as to apply a moment to the second pawl in a releasing direction.

14. The latch assembly as defined in claim 11, wherein the release lever is operable to move the auxiliary pawl from the auxiliary pawl retaining position to the auxiliary pawl release position.

15. The latch assembly as in claim 14, wherein movement of the release lever from the release position to the rest position allows the second pawl to move from the second pawl disengaged position to the second pawl engaged position.

16. The latch assembly as in claim 1, wherein the second pawl is rotatable about a second pawl axis and with the latch bolt in the first safety position and the second pawl in the second pawl engaged position a force applied to the second pawl by the latch bolt passes to one side of the second pawl axis so as to apply a moment to the second pawl in a releasing direction.

* * * * *